US008858024B2

(12) United States Patent
Wu et al.

(10) Patent No.: US 8,858,024 B2
(45) Date of Patent: Oct. 14, 2014

(54) ILLUMINATING APPARATUS AND ILLUMINATING MODULE

(71) Applicant: Delta Electronics, Inc., Taoyuan Hsien (TW)

(72) Inventors: Hsiang-Chen Wu, Taoyuan Hsien (TW); Li-Ming Chen, Taoyuan Hsien (TW); Chih-Yuan Huang, Taoyuan Hsien (TW)

(73) Assignee: Delta Electronics, Inc., Taoyuan (TW)

( * ) Notice: Subject to any disclaimer, the term of this patent is extended or adjusted under 35 U.S.C. 154(b) by 187 days.

(21) Appl. No.: 13/646,237

(22) Filed: Oct. 5, 2012

(65) Prior Publication Data

US 2013/0194799 A1 Aug. 1, 2013

(30) Foreign Application Priority Data

Feb. 1, 2012 (TW) ..... 101103258 A

(51) Int. Cl.
*F21V 5/00* (2006.01)
*F21V 5/04* (2006.01)
*F21Y 103/00* (2006.01)

(52) U.S. Cl.
CPC ..... *F21V 5/007* (2013.01); *F21V 5/046* (2013.01); *F21Y 2103/003* (2013.01)
USPC ..... 362/244; 362/249.02; 362/240

(58) Field of Classification Search
CPC . F21Y 2101/02; F21Y 2103/003; F21K 9/00; F21S 4/008; F21V 5/007; F21V 5/046; F21V 5/048; F21V 19/003; F21V 19/0035; F21V 19/0055
USPC ..... 362/249.02, 240, 244, 238, 235, 267
See application file for complete search history.

(56) References Cited

U.S. PATENT DOCUMENTS

| | | | | |
|---|---|---|---|---|
| 8,310,158 | B2 * | 11/2012 | Coplin et al. | 315/32 |
| 8,461,603 | B2 * | 6/2013 | Wu et al. | 257/88 |
| 2008/0273327 | A1 * | 11/2008 | Wilcox et al. | 362/267 |
| 2012/0182755 | A1 * | 7/2012 | Wildner | 362/555 |

* cited by examiner

*Primary Examiner* — Peggy Neils
(74) *Attorney, Agent, or Firm* — Muncy, Geissler, Olds & Lowe, P.C.

(57) ABSTRACT

An illuminating module includes a cover body, a plurality of lens elements, a flexible element and a light-emitting component. The cover body has a plurality of first through holes. The lens elements are opposite to the first through holes, respectively, and the size of each lens element is made compatible with the size of each first through hole. The lens elements are disposed between the flexible element and the cover body. The light-emitting component has a circuit board and a plurality of light emitting diodes. The light emitting diodes are disposed on the circuit board and opposite to the lens elements, respectively. The lights emitted from the light emitting diodes are outputted through the lens elements respectively.

20 Claims, 4 Drawing Sheets

ILLUMINATING APPARATUS AND ILLUMINATING MODULE

CROSS REFERENCE TO RELATED APPLICATIONS

This Non-provisional application claims priority under 35 U.S.C. §119(a) on Patent Application No(s). 101103258 filed in Taiwan, Republic of China on Feb. 1, 2012, the entire contents of which are hereby incorporated by reference.

BACKGROUND OF THE INVENTION

1. Field of Invention

The present invention relates to an illuminating apparatus and illuminating module and, in particular, to an illuminating apparatus and illuminating module with light emitting diodes.

2. Related Art

The traditional street illuminating apparatus usually uses mercury lamp or high pressure sodium lamp as its light source. Although the traditional illuminating apparatus can illuminate boarder region, they are more energy exhausting, non-recyclable and less environment protecting. Recently, the light emitting diode (LED) is highly developed and it has the advantages of high brightness, energy-saving, environment friendly and longer life span, so that it is broadly used in lamps and further applied to street illuminating apparatus.

However, the conventional light emitting diode lamp comprises a cover body, a plurality of lens, a plurality of light emitting diodes, heat dissipating fins and etc. These components are delicate, so more attention should be paid on the relative position of the components when assembling; therefore, more time and labor are wasted on positioning the components to the correct relative position and assembling. Additionally, the internal components of the conventional lamps are easily displaced because of external force or impact, and further affect the angle and amount of light emitted from the light emitting diode.

Besides, according of the island-type climate, high temperature and humidity of Taiwan, the furniture and the electronic apparatus exposure to humidity are easily being moldy, breeding germs, leaking electricity. It would cause short circuit of the electronic apparatus or even breakage of the apparatus.

Furthermore, the high power light emitting diode applied would produce high temperature when running. A plurality of light emitting diodes is needed within the illuminating apparatus to provide sufficient light. The light emitting diodes must be welded to the circuit board and the heat is gathered to the same heat sink. Because of synergistic effect of heat flow and because that the illuminating apparatus can not be overweight or over-sized, the area of the heat sink is limited. Therefore, bad design of the heat dissipating mechanism may result in low heat dissipating efficiency of the light emitting diode lamps. High temperature may also easily result in destroy of some light emitting diode components and shorten the life-span.

Therefore, it is an important subject to provide an illuminating apparatus and an illuminating module, which can save the assembling and positioning time, prevent moisture from invading into the internal of the illuminating module, and arise the heat dissipating efficiency.

SUMMARY OF THE INVENTION

In view of the foregoing, an object of this invention is to provide an illuminating apparatus and an illuminating module, which save the time for assembling and positioning, prevent moisture from invading into the internal of the illuminating module, arise heat dissipating efficiency, and prolong the life span thereof.

To achieve the above object, the present invention discloses an illuminating module, which comprises a cover body, a plurality of lens elements, a flexible element and a light-emitting component. The cover body has a plurality of first through holes. Each of the lens elements is disposed opposite to the first through holes, respectively, and the size of each of the lens elements is made compatible with the size of the corresponding first through hole. The lens elements are disposed between the flexible element and the cover body. The light-emitting component has a circuit board and a plurality of light emitting diodes. The light emitting diodes are disposed on the circuit board and opposite to the lens elements, respectively, and the lights emitted from the light emitting diodes are outputted through the lens elements respectively.

To achieve the above object, the present invention further discloses an illuminating apparatus, which comprises a plurality of illuminating module, a casing and a supporting element. Each of the illuminating modules comprises a cover body, a plurality of lens elements, a flexible element and a light-emitting component. The cover body has a plurality of first through holes. The lens elements are disposed opposite to the through holes, respectively, and the size of each of the lens elements is made compatible with the size of the corresponding first through hole. The lens elements are disposed between the flexible element and the cover body. The light-emitting component has a circuit board and a plurality of light emitting diodes. The light emitting diodes are disposed on the circuit board and opposite to the lens elements, respectively, and the lights emitted from the light emitting diodes are outputted through the lens elements respectively. The illuminating modules are connected in serial or in parallel and disposed in the casing, and the illuminating apparatus outputs the light from one side of the casing. The supporting element is connected to the casing for supporting the casing.

Each lens element comprises a lens part and a protrusion connecting to the periphery of the lens part, and the lights emitted from the light emitting diodes are outputted through the lens parts, respectively. The upper surface of each protrusion is attached to the periphery of each first through hole, respectively.

In one embodiment of the present invention, the flexible element comprises a plurality of second through holes disposed corresponding to the first through holes and the light emitting diodes, respectively.

In one embodiment of the present invention, the lower surface of each if the protrusions is connected to the periphery of each of the second through holes, respectively.

In one embodiment of the present invention, the material of the flexible element comprises rubber.

In one embodiment of the present invention, the illuminating module further comprises a block plate and an insulating layer. The block plate is disposed between the flexible element and the light-emitting component, and the insulating layer is disposed between the block plate and the light-emitting component.

In one embodiment of the present invention, the illuminating module further comprises a heat conducting layer connected to the light-emitting component.

In one embodiment of the present invention, the illuminating apparatus further comprises a heat dissipating element connecting to the light-emitting component and disposed at one side of the illuminating module corresponding to the cover.

As mentioned above, the illuminating apparatus and the illuminating module of this present invention include the cover body, a plurality of the lens elements, the flexible element and the light-emitting component. The lens elements are disposed correspond to the plurality of the first through holes of the cover body. The lens elements are disposed between the flexible element and the cover body. The first through holes and the lens elements are disposed correspond to the plurality of the light emitting diodes of the light-emitting components. Thus, the light emitted from the light-emitting diodes can be outputted from the corresponding lens elements.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
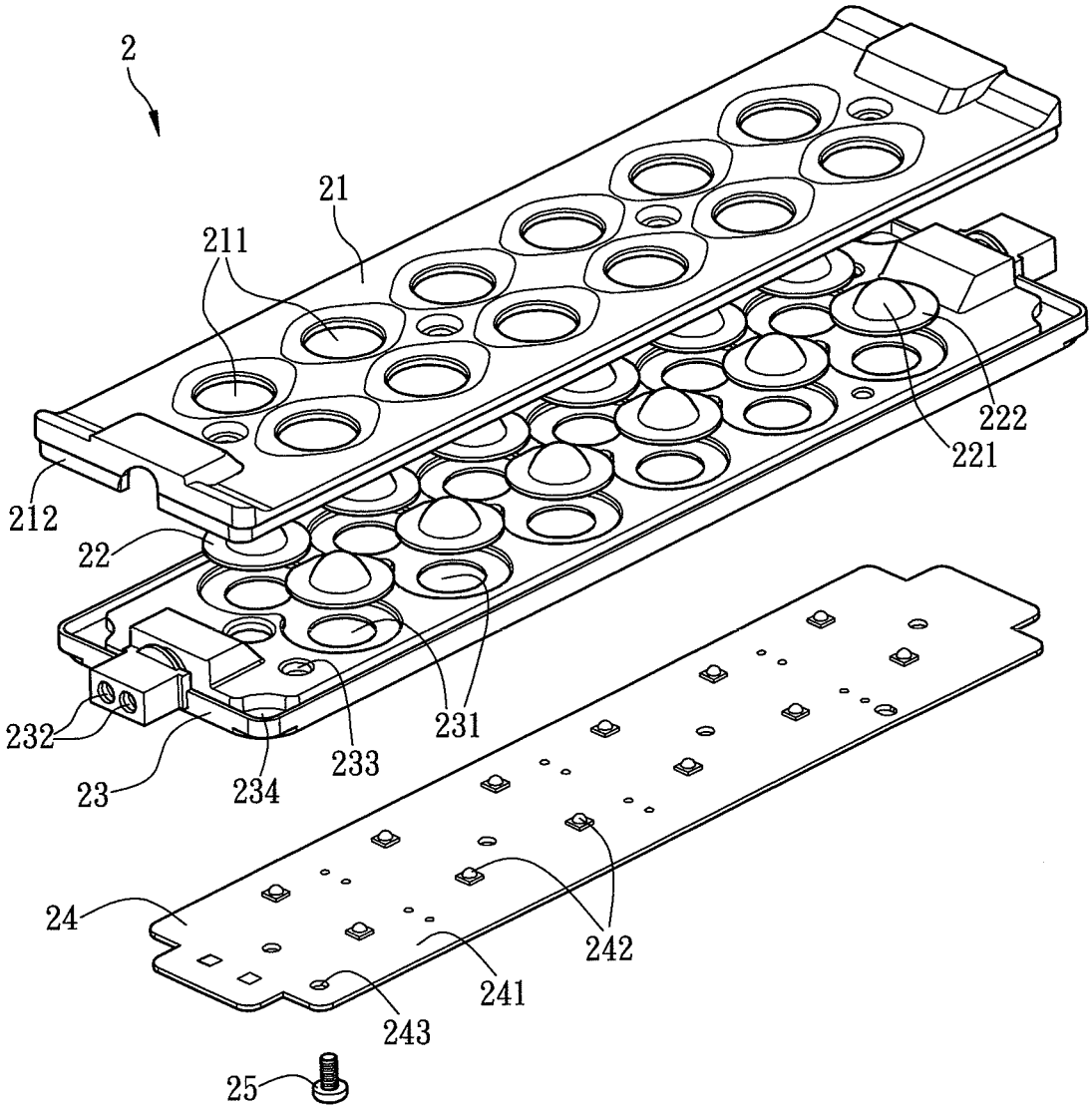
FIG. 1 is an explode diagram of an illuminating module according to a preferred embodiment of the present invention.

FIG. 1 is an explode diagram of an illuminating module according to a preferred embodiment in the present invention. Referring to FIG. 1, the illuminating module 2 comprises a cover body 21, a plurality of lens elements 22, a flexible element 23, and a light-emitting component 24.

The material of the cover body 21 is, for example but not limited to, metal, alloy or plastics fitting 5VA flammability standard. The cover body 21 of this embodiment comprises a plurality of first through holes 211.

The lens elements 22 are disposed opposite to the through holes 211, respectively. The size of each lens element 22 is made compatible with the size of the corresponding first through hole 211; thus, the lens elements 22 are able to lock the through holes 211 and protrude from the through holes 211 of the cover body 21. Each lens element 22 comprises a lens part 221 and a protrusion 222, and the protrusion 222 connects to the periphery of the lens part 221. The upper surface of each protrusion 222 are attached to the periphery of each first through hole 211 and the protrusion 222 is also stuck to the periphery of the first through hole 211 by adhesive to add water proof effect. Besides, the lens elements 22 are a single element or an integral component. The lens elements 22 of this embodiment are an example of single element, but it is not the limitation of the present invention.

The flexible element 23 is disposed opposite to the lens elements 22. In detail, the lens elements 22 are disposed between the flexible element 23 and the cover body 21. The flexible element 23 can be made, for example, of rubber, to absorb the heat produced by the light-emitting component 24, and to prevent displacement of the lens elements 22 due to thermal expansion. The flexible element 23 can be made of other materials with water-proof and/or heat absorption functions. Further, the flexible element 23 comprises a plurality of second through holes 231. Each second through hole 231 is disposed correspond to the first through hole 211, respectively. The lower surface of each protrusion 222 is connected to the periphery of each second through hole 231 and the upper surface of the protrusion 222 is attached to the periphery of the first through hole 211. Besides, the shape of the upper surface of the protrusion 222 is compatible with the periphery of the first through hole 211 and the shape of the lower surface of the protrusion 222 is compatible with the periphery of the second through hole 231; thus, it can increase the convenience for assembling the cover body 21, the lens elements 22 and the flexible element 23, is able to positioning and prevents moisture and dust to invade the internal of the illuminating module 2. In addition, the flexible element 23 further comprises 4 sockets 232 disposed on two sides of the flexible element 23. The wire can be plug into the socket 232 to electrically connect to the illuminating module 2 for supplying power to the illuminating module 2.

The light-emitting component 24 comprises a circuit board 241 and a plurality of the light emitting diodes 242. The light emitting diodes 242 are disposed on the circuit board 241. Each of the light emitting diodes 242 is disposed correspond to the first through hole 211, the lens element 22 and the second through hole 231, respectively. Each of the light emitting diodes 242 emits lights passing through the second through hole 231, the lens part 221 and the first through hole 211, thereby emitting the light through the corresponding lens element 22. Besides, the number of the light emitting diode 242 are made compatible with the number of the first through hole 211, the lens element 22 and the second through hole 231. For example, twelve light emitting diodes 242 are disposed on the circuit board 211 in the embodiment shown in FIG. 1, and therefore the number of the first through hole 211, the lens element 22 and the second through hole are corresponding to the number of the light emitting diode 242. Then, the light emitting diode 242 emits light passing through the corresponding second through hole 231, the lens element 22 and the first through hole 211.

The illuminating module 2 further comprises a limit element 25. The cover body 21, the flexible element 23 and the light emitting component 24 each comprises a limit hole (e.g. limit hole 233, 243). The limit element 25 is disposed through the limit hole 233 of the flexible element 23 and the limit hole 243 of the light-emitting component 24 and fixed to the limit hole of the cover body 21 (not shown), and then fix the relative position of the cover body 21, the flexible element 23 and the light-emitting component 24. Besides, the flexible element 23 in this embodiment comprises a locating slot 234. The cover body 21 comprises a locating part 212 correspond to the locating slot 234 of the flexible element 23. The size and the shape of the locating slot 234 are made compatible with those of the locating part 212. Thus, when the cover body 21 is connected to the flexible element 23, the locating part 212 is disposed correspond to the locating slot 234 to fix position and to increase the closeness between the cover body 21 and the flexible element 23.

Figure 2:
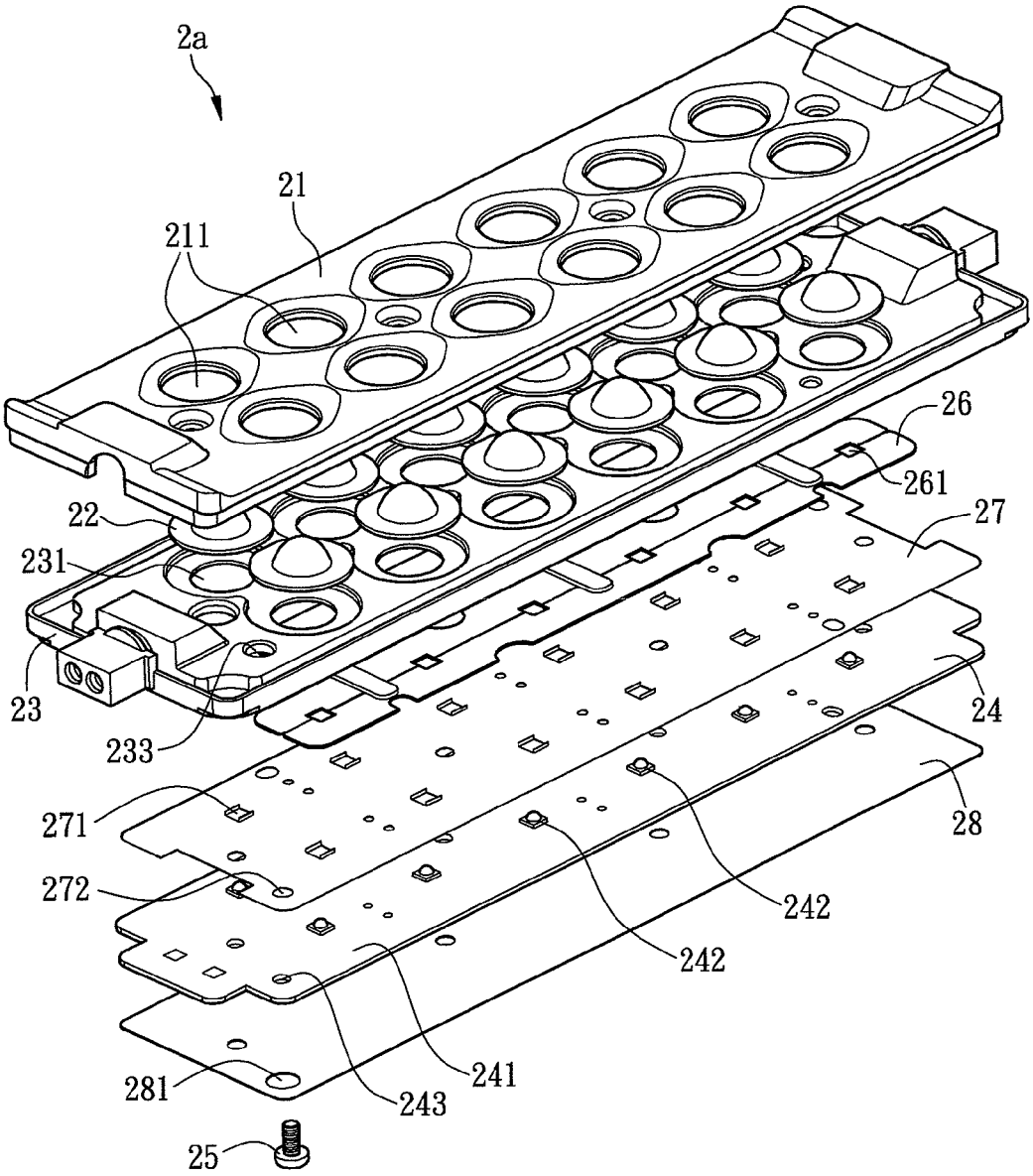
FIG. 2 is an explode diagram of an illuminating module according to another embodiment of the present invention.

Referring to FIG. 2, FIG. 2 is an explode diagram of another illuminating module according to another embodiment of the present invention. Additionally, an illuminating module 2*a* further comprises a block plate 26 and an insulating layer 27. The block plate 26 and the insulating layer 27 are disposed between the flexible element 23 and the light-emitting component 24. In detail, the block plate 26 is disposed close to the flexible element 23 and between the insulating layer 27 and the flexible element 23. The insulating layer 27 is disposed close to the light-emitting component 24 and between the block plate 26 and the light-emitting component 24. The flexible element 23, the block plate 26, the insulating layer 27 and the light-emitting component 24 are disposed in order from top to bottom. Wherein, the block plate is made of, for example, metal or plastics fitting 5VA flammability standard. The insulating layer 27 is made of white plastic sheet with reflection and insulation functions. The insulating layer 27 is disposed between the block plate 26 and the circuit board 241 to avoid electric connection therebetween. To follow the safety regulation, the circuit on the circuit board 241 is sheltered by disposing the block plate 26 and the insulating layer 27. In this embodiment, the block plate 26 comprises a plurality of the third through holes 261 and the insulating layer 27 comprises a plurality of the fourth through holes 271. The third through holes 261 and the fourth through holes 271 are disposed correspond to the light emitting diodes 242, respectively. When the block plate 26 and the insulating layer 27 are disposed on the light-emitting component 24, and the light emitting diodes 242 are disposed through the third and fourth through holes 261, 271. Then, the light emitting diode 242 emits lights through the third and fourth through holes 261, 271. The block plate 26 and the insulating layer 27 shelter the circuit of the circuit board 241 to meet the safety standard.

In this embodiment, the block plate 26 is formed by two mirror-symmetrical parts. At least one recess is formed on adjacent sides of the two mirror-symmetrical parts so that the third through holes 261 can be formed therebetween. The size of the third through holes 261 can be changed by adjusting the distance between the two mirror-symmetrical parts.

Additionally, the illuminating module 2*a* further comprises a heat conducting layer 28 connected to the light-emitting component 24 and is disposed opposite to the insulating layer 27. The heat conducting layer 28 can be, for example, heat conducting gel to conduct heat to somewhere else.

The insulating layer 27 and the heat conducting layer 28 comprise limit holes 272 and 281, respectively, disposed corresponding to the limit hole 233 of the flexible element 23 and the limit hole 243 of the light-emitting component 24, respectively. The limit element 25 is disposed through the limit hole 281 of the heat con ducting layer 28, the limit hole 243 of the light-emitting component 24, the limit hole 272 of the insulating layer 27 and the limit hole 233 of the flexible element in order, and fixed to the limit hole of the cover body (not shown). Then, the relative position of the heat conducting layer 28, the light-emitting component 24, the insulating layer 27, the block plate 26 and the flexible element 23, the lens elements 22 and the cover body 21 is fixed. The number of the limit holes of the heat conducting layer 28, the light-emitting component 24, the insulating layer 27 and the flexible element 23 is not limited to this embodiment of the present invention. In other examples, the heat conducting layer, the light-emitting component, the insulating layer and the flexible element are disposed with plurality of limit holes. However, the limit hole of the heat conducting layer, the limit hole of the light-emitting component, the limit of the insulating layer and the limit hole of the flexible element are disposed correspond to one another.

Figure 3:
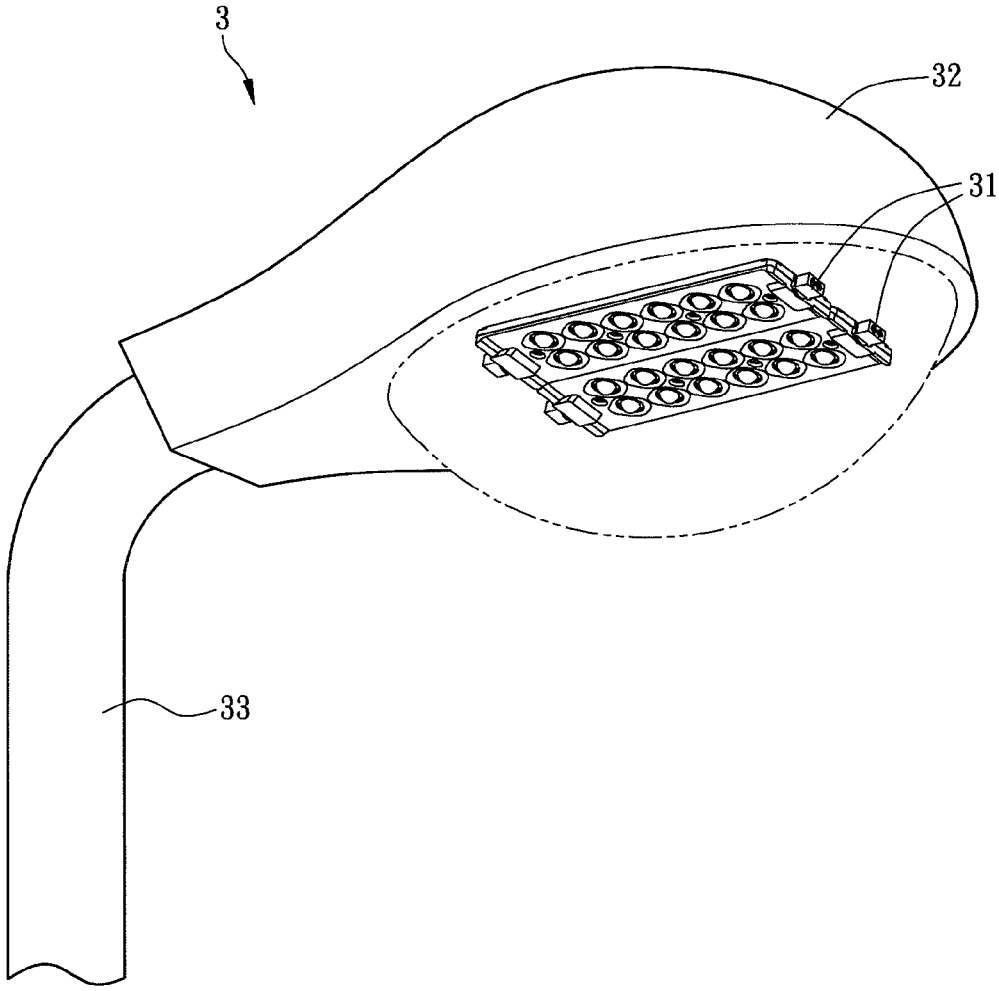
FIG. 3 is a schematic diagram of an illuminating apparatus according to a preferred embodiment of the present invention.

FIG. 3 is a schematic diagram of the illuminating apparatus according to a preferred embodiment of the present invention. Referring to FIG. 3, an illuminating apparatus 3 is, for example but no limited to, a street lamp, a desk lamp, a table lamp, a wall lamp, a pendant lamp, a floor lamp, a ceiling lamp, an office light or business illumination and etc. The illumination apparatus 3 includes plurality of the illuminating modules 31, a casing 32 and a supporting element 33. Wherein, the illuminating modules 31 comprises the same technical features with the illuminating module 2 or 2*a* in the above-mentioned embodiments; thus, there would be no further descriptions here.

The illuminating apparatus 3 of this embodiment is an example of comprising two illuminating modules 31, but the set number is not a limitation of the present invention. In other embodiments, the illuminating apparatus includes three, four or eight illuminating modules or so. The number of the illuminating module shall be disposed according to the illuminating apparatus size and the environment. The illuminating modules 31 are disposed serial or parallel connected in the casing 32. The illuminating apparatus 3 emits lights from one side of the casing 32. As shown in FIG. 3, the illuminating apparatus 3 in this embodiment, for example, emits lights downward.

The supporting element 33 is connected to the casing 32 and supporting the casing 32. The illuminating apparatus 3 in this embodiment is an example of street lamp. The supporting element 33 is disposed on the floor and supporting the casing 32. The illuminating apparatus 3 can light the floor and provide the light to the pedestrian.

Figure 4:
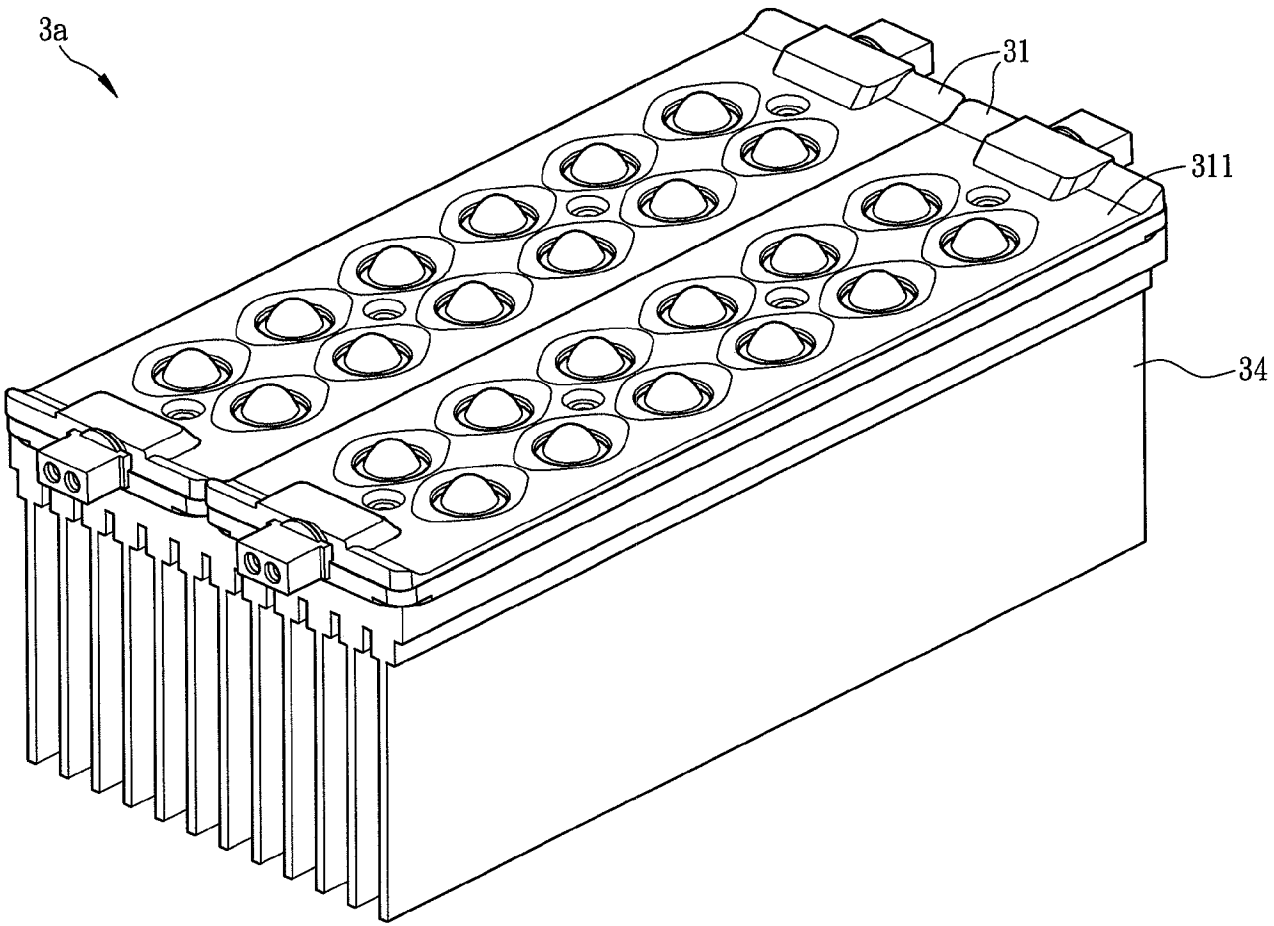
FIG. 4 is partial schematic diagram of an illuminating apparatus according to another embodiment of the present invention.

FIG. 4 is a partial schematic diagram of an illuminating apparatus according to another embodiment of the present invention. To make it easily understood and viewed, the casing 32 and the supporting element 33 shown in FIG. 3 are omitted in FIG. 4.

The illuminating apparatus 3*a* further comprises a heat dissipating element 34 connecting to the light-emitting component of the illuminating modules 31 for increasing the heat dispersion efficiency by connecting to the heat conducting layer of the illuminating modules 31. The heat dissipating element 34 is disposed on one side of the illuminating 31 opposite to the cover body 311. The heat dissipating element 34 can be, for example, the heat dissipating fins to disperse the heat of the illuminating modules 31. Besides, in this embodiment, the illuminating modules 31 are locked to the heat dissipating element 34 by the locking element, such as screw and etc.

In summary, the illuminating apparatus and the illuminating module of this present invention include the cover body, a plurality of the lens elements, the flexible element and the light-emitting component. The lens elements are disposed correspond to the plurality of the first through holes of the cover body. The lens elements are disposed between the flexible element and the cover body. The first through holes and the lens elements are disposed correspond to the plurality of the light emitting diodes of the light-emitting components. Thus, the light emitted from the light-emitting diodes is outputted from the corresponding lens elements. Disposing the flexible element can absorb the heat dispersed from of the light-emitting components, increase the heat dispersion efficiency of the light-emitting components and prevent displacement of the lens elements due to thermal expansion.

In addition, the flexible element comprises a plurality of the second through holes. The lens elements are disposed correspond to the first through holes and the second through holes and their sizes are made compatible with each other. Therefore, it is able to avoid the moisture and the dust to enter the internal of the illuminating module. Further, the flexible element and the cover body comprise the locating slot and the locating part, respectively; thus, it is able to increase the convenience for assembling the flexible element, the lens element and the cover body, and save the assembling time and labor.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An illuminating module, comprising:

a cover body having a plurality of first through holes;

a plurality of lens elements disposed opposite to the first through holes, respectively, and the size of each of the lens elements is made compatible with the size of the corresponding first through hole;

a flexible element, wherein the lens elements are disposed between the flexible element and the cover body; and a light-emitting component having a circuit board and a plurality of light emitting diodes, wherein the light emitting diodes are disposed on the circuit board and opposite to the lens elements, respectively, and the lights emitted from the light emitting diodes are outputted through the lens elements respectively.

2. The illuminating module according to claim 1, wherein each of the lens elements comprises a lens part and a protrusion connecting to the periphery of the lens part, and the lights emitted from the light emitting diodes are outputted through the lens parts, respectively.

3. The illuminating module according to claim 2, wherein the upper surface of each of the protrusions is attached to the periphery of each of the first through holes, respectively.

4. The illuminating module according to claim 2, wherein the flexible element comprises a plurality of second through holes disposed corresponding to the first through holes and the light emitting diodes, respectively.

5. The illuminating module according to claim 4, wherein the lower surface of each if the protrusions is connected to the periphery of each of the second through holes, respectively.

6. The illuminating module according to claim 1, where the material of the flexible element comprises rubber.

7. The illuminating module according to claim 1, further comprising:

a block plate disposed between the flexible element and the light-emitting component; and an insulating layer disposed between the block plate and the light-emitting component.

8. The illuminating module according to claim 7, wherein the block plate is formed by two mirror-symmetrical parts.

9. The illuminating module according to claim 7, wherein the block plate is made of metal or plastics fitting 5VA flammability standard.

10. The illuminating module according to claim 1, further comprising:

a heat conducting layer connected to the light-emitting component.

11. An illuminating apparatus, comprising:

a plurality of illuminating modules, each of which comprising:

a cover body having a plurality of first through holes, a plurality of lens elements disposed opposite to the through holes, respectively, wherein the size of each of the lens elements is made compatible with the size of the corresponding first through hole, a flexible element, wherein the lens elements are disposed between the flexible element and the cover body, and a light-emitting component having a circuit board and a plurality of light emitting diodes, wherein the light emitting diodes are disposed on the circuit board and opposite to the lens elements, respectively, and the lights emitted from the light emitting diodes are outputted through the lens elements respectively;

a casing, wherein the illuminating modules are connected in serial or in parallel and disposed in the casing, wherein the illuminating apparatus outputs the light from one side of the casing; and a supporting element connected to the casing for supporting the casing.

12. The illuminating apparatus according to claim 11, wherein each of the lens elements comprises a lens part and a protrusion connecting to the periphery of the lens part, and the lights emitted from the light emitting diodes are outputted through the lens parts, respectively.

13. The illuminating apparatus according to claim 12, wherein the upper surface of each of the protrusions is attached to the periphery of each of the first through holes, respectively.

14. The illuminating apparatus according to claim 12, wherein the flexible element comprises a plurality of second through holes disposed corresponding to the first through holes and the light emitting diodes, respectively.

15. The illuminating apparatus according to claim 14, wherein the lower surface of each if the protrusions is connected to the periphery of each of the second through holes, respectively.

16. The illuminating apparatus according to claim 11, where the material of the flexible element comprises rubber.

17. The illuminating apparatus according to claim 11, further comprising:

a block plate disposed between the flexible element and the light-emitting component; and an insulating layer disposed between the block plate and the light-emitting component.

18. The illuminating apparatus according to claim 17, wherein the block plate is formed by two mirror-symmetrical parts and made of metal or plastics fitting 5VA flammability standard.

19. The illuminating apparatus according to claim 11, further comprising:

a heat conducting layer connected to the light-emitting component.

20. The illuminating apparatus according to claim 11, further comprising:

a heat dissipating element connecting to the light-emitting component and disposed at one side of the illuminating module corresponding to the cover.

* * * * *